US007035582B2

(12) United States Patent
Suda et al.

(10) Patent No.: US 7,035,582 B2
(45) Date of Patent: Apr. 25, 2006

(54) IMAGE FORMING APPARATUS AND PROCESS CARTRIDGE INCLUDING LUBRICANT APPLYING DEVICE THAT PREVENTS WASTE OF LUBRICANT

(75) Inventors: Takeo Suda, Tokyo (JP); Shinichi Kawahara, Tokyo (JP); Takaaki Tawada, Yokohama (JP); Chohtaroh Kataoka, Tokyo (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 10/861,495

(22) Filed: Jun. 7, 2004

(65) Prior Publication Data

US 2005/0019070 A1 Jan. 27, 2005

(30) Foreign Application Priority Data

Jun. 6, 2003 (JP) ..... 2003-162739

(51) Int. Cl.
*G03G 21/18* (2006.01)

(52) U.S. Cl. ..... 399/346

(58) Field of Classification Search ..... 399/346, 399/359

See application file for complete search history.

(56) References Cited

U.S. PATENT DOCUMENTS

| | | | | |
|---|---|---|---|---|
| 5,493,365 | A | 2/1996 | Matsui et al. | |
| 5,532,795 | A | 7/1996 | Tatsumi et al. | |
| 5,572,293 | A | 11/1996 | Kikuchi et al. | |
| 5,596,395 | A | 1/1997 | Sawamura et al. | |
| 5,610,691 | A | 3/1997 | Takahashi et al. | |
| 5,678,125 | A | 10/1997 | Kutsuwada et al. | |
| 5,815,767 | A | 9/1998 | Kutsuwada et al. | |
| 5,887,224 | A | 3/1999 | Mizuishi et al. | |
| 5,909,609 | A | 6/1999 | Yahata et al. | |
| 5,915,143 | A | 6/1999 | Watanabe et al. | |
| 5,923,936 | A | 7/1999 | Tanoue et al. | |
| 5,950,062 | A | 9/1999 | Yahata et al. | |
| 6,006,050 | A | 12/1999 | Watanabe et al. | |
| 6,055,388 | A | 4/2000 | Watanabe et al. | |
| 6,055,394 | A | 4/2000 | Suda et al. | |
| 6,097,914 | A | 8/2000 | Tanaka et al. | |
| 6,101,351 | A | 8/2000 | Suda et al. | |
| 6,256,465 | B1 | 7/2001 | Yoshinaga et al. | |
| 6,336,013 | B1 | 1/2002 | Suda et al. | |
| 6,337,957 | B1 | 1/2002 | Tamaki et al. | |
| 6,363,237 | B1 * | 3/2002 | Nagame et al. | 399/343 |

(Continued)

FOREIGN PATENT DOCUMENTS

| | | |
|---|---|---|
| EP | 0 663 621 | 7/1995 |

(Continued)

*Primary Examiner*—Quana Grainger
(74) *Attorney, Agent, or Firm*—Oblon, Spivak, McClelland, Maier & Neustadt, P.C.

(57) ABSTRACT

An image forming apparatus includes a moving member, a cleaning device that removes toner attached onto a surface of the moving member, and a lubricant applying device that is provided at the outside of the cleaning device and applies a lubricant onto the surface of the moving member to decrease the coefficient of friction between the surface of the moving member and a substance in contact with the surface of the moving member. The lubricant applying device includes a casing having an opening facing the surface of the moving member and having an inner wall surface. A closed space is formed by being surrounded by the inner wall surface of the casing and the surface of the moving member, and the lubricant applying device accommodates the lubricant in the closed space and applies the lubricant to the surface of the moving member in the closed space.

34 Claims, 7 Drawing Sheets

U.S. PATENT DOCUMENTS

| | | | | |
|---|---|---|---|---|
| 6,463,237 | B1 | 10/2002 | Suda et al. | |
| 6,522,855 | B1 | 2/2003 | Katoh et al. | |
| 6,529,699 | B1 * | 3/2003 | Ishii et al. | 399/159 |
| 6,560,414 | B1 | 5/2003 | Suda et al. | |
| 6,577,842 | B1 * | 6/2003 | Akiba et al. | 399/359 |
| 6,763,208 | B1 | 7/2004 | Nagatsuna et al. | |

FOREIGN PATENT DOCUMENTS

| | | | |
|---|---|---|---|
| JP | 59-147373 | | 8/1984 |
| JP | 63223772 | A * | 9/1988 |
| JP | 9-146433 | | 6/1997 |
| JP | 10-186989 | | 7/1998 |
| JP | 10307522 | A * | 11/1998 |
| JP | 10312142 | A * | 11/1998 |
| JP | 11219087 | A * | 8/1999 |
| JP | 2000-35727 | | 2/2000 |
| JP | 2000-231299 | | 8/2000 |
| JP | 2001-51561 | | 2/2001 |
| JP | 2001051571 | A * | 2/2001 |
| JP | 2003-140518 | | 5/2003 |

* cited by examiner

IMAGE FORMING APPARATUS AND PROCESS CARTRIDGE INCLUDING LUBRICANT APPLYING DEVICE THAT PREVENTS WASTE OF LUBRICANT

CROSS-REFERENCE TO RELATED APPLICATIONS

This application claims priority to Japanese Patent Application No. 2003-162739 filed in the Japanese Patent Office on Jun. 6, 2003, the entire contents of which is hereby incorporated herein by reference.

BACKGROUND OF THE INVENTION

1. Field of the Invention

The present invention relates to an image forming apparatus, such as a facsimile machine, a printer, a copying machine, or other similar image forming apparatus, and more particularly to a process cartridge detachably attached to a main body of an image forming apparatus.

2. Discussion of the Related Art

An image forming apparatus including a cleaning device that removes residual toner attached onto a surface of a photoconductive drum has been widely used. The photoconductive drum functions as one of the moving members used in the image forming apparatus, and will be referred to as a moving member hereafter. In such an image forming apparatus, a lubricant is applied onto a surface of the moving member to decrease the coefficient of friction between the surface of the moving member and a cleaning blade of the cleaning device that contacts the surface of the moving member. By doing so, the wear of the surface of the moving member by the cleaning blade and the abrasion of the cleaning blade are avoided. As a result, the useful lifetime of the moving member may be extended, and image deterioration caused by poor cleaning performance of the cleaning blade may be minimized or avoided. The above-described image forming apparatus is described, for example, in Published Japanese patent application Nos. 2000-35727, 2000-231299, and 2001-51561.

There is a background image forming apparatus (hereafter referred to as a "first background image forming apparatus") in which a lubricant is applied onto a surface of a moving member, such as a photoconductive drum, and an intermediate transfer element, by bringing a solid lubricant into contact with the surface of the moving member. There is another background image forming apparatus (hereafter referred to as a "second background image forming apparatus") in which a solid lubricant is scrapped off by a brush roller and is transformed into a powder lubricant. The powder lubricant is applied to a surface of a moving member, such as a photoconductive drum, and an intermediate transfer element, by the brush roller. In these first and second background image forming apparatuses, if the solid lubricant and the brush roller are not accommodated in a casing, a part of the lubricant to be applied onto the surface of the moving member is typically scattered in the image forming apparatus. Because the lubricant is wasted due to the scattered lubricant, a greater amount of lubricant than necessary needs to be prepared considering the waste of lubricant. In this case, the greater amount of lubricant may hinder the downsizing of the image forming apparatus.

Further, there is another background image forming apparatus (hereafter referred to as a "third background image forming apparatus") in which a lubricant applying mechanism is provided in a cleaning device. For example, in the lubricant applying mechanism, a solid lubricant is scraped off by a brush roller, and the scraped lubricant is applied onto a surface of a moving member. Generally, a cleaning device is configured to collect toner removed from a surface of a moving member by a cleaning member, and the collected toner does not scatter from the cleaning device into a main body of an image forming apparatus. Therefore, the solid lubricant scraped off by the brush roller in the cleaning device does not scatter from the cleaning device into a main body of an image forming apparatus.

However, in the third background image forming apparatus, when the rotating brush roller scrapes off the solid lubricant and applies the scraped lubricant onto the surface of the moving member, a part of the scraped lubricant scatters in the cleaning device. The lubricant scattered in the cleaning device is conveyed together with toner removed from the surface of the moving member by the cleaning member to a container, such as a waste toner collection bottle. Similar to the first and second background image forming apparatuses, a greater amount of lubricant than necessary needs to be prepared considering the waste of lubricant (i.e., the scattered lubricant) in the third background image forming apparatus. In this case, a greater amount of lubricant may prevent the downsizing of the image forming apparatus.

The above-described problem of wasting lubricants occurs not only in the above-described configurations, but also occurs in a configuration in which an originally powdered lubricant (i.e., not a lubricant transformed from a solid lubricant to a powder lubricant) is applied onto a surface of a moving member, and in a configuration in which a liquid lubricant is applied to a surface of a moving member, and in other configurations.

SUMMARY OF THE INVENTION

In view of the above, the present inventors recognized a need exists for an image apparatus and a process cartridge including a lubricant applying device that prevents a waste of lubricant.

According to an aspect of the present invention, an image forming apparatus includes a moving member, a cleaning device configured to remove toner attached onto a surface of the moving member, and a lubricant applying device provided at the outside of the cleaning device and configured to apply a lubricant onto the surface of the moving member to decrease a coefficient of friction between the surface of the moving member and a substance in contact with the surface of the moving member. The lubricant applying device includes a casing having an opening facing the surface of the moving member, having first and second edge portions adjoining the opening and contacting the surface of the moving member, and having an inner wall surface. A closed space is formed by being surrounded by the inner wall surface of the casing and the surface of the moving member, and the lubricant applying device accommodates the lubricant in the closed space and applies the lubricant to the surface of the moving member in the closed space.

According to another aspect of the present invention, a process cartridge for use in a main body of an image forming apparatus includes at least a moving member, a cleaning device configured to remove toner attached onto a surface of the moving member, and a lubricant applying device provided at an outside of the cleaning device and configured to apply a lubricant onto the surface of the moving member to decrease a coefficient of friction between the surface of the moving member and a substance in contact with the surface of the moving member. The lubricant applying device includes a casing having an opening facing the surface of the moving member and having an inner wall surface. The moving member, the cleaning device, and the lubricant applying device are integrally accommodated in the process cartridge, and the process cartridge is detachably attached to the main body of the image forming apparatus. A closed space is formed by being surrounded by the inner wall surface of the casing and the surface of the moving member, and the lubricant applying device accommodates the lubricant in the closed space and applies the lubricant to the surface of the moving member in the closed space.

BRIEF DESCRIPTION OF THE DRAWINGS

A more complete appreciation of the present invention and many of the attendant advantages thereof will be readily obtained as the same becomes better understood by reference to the following detailed description when considered in connection with the accompanying drawings, wherein.

DESCRIPTION OF THE PREFERRED EMBODIMENTS

Figure 1:
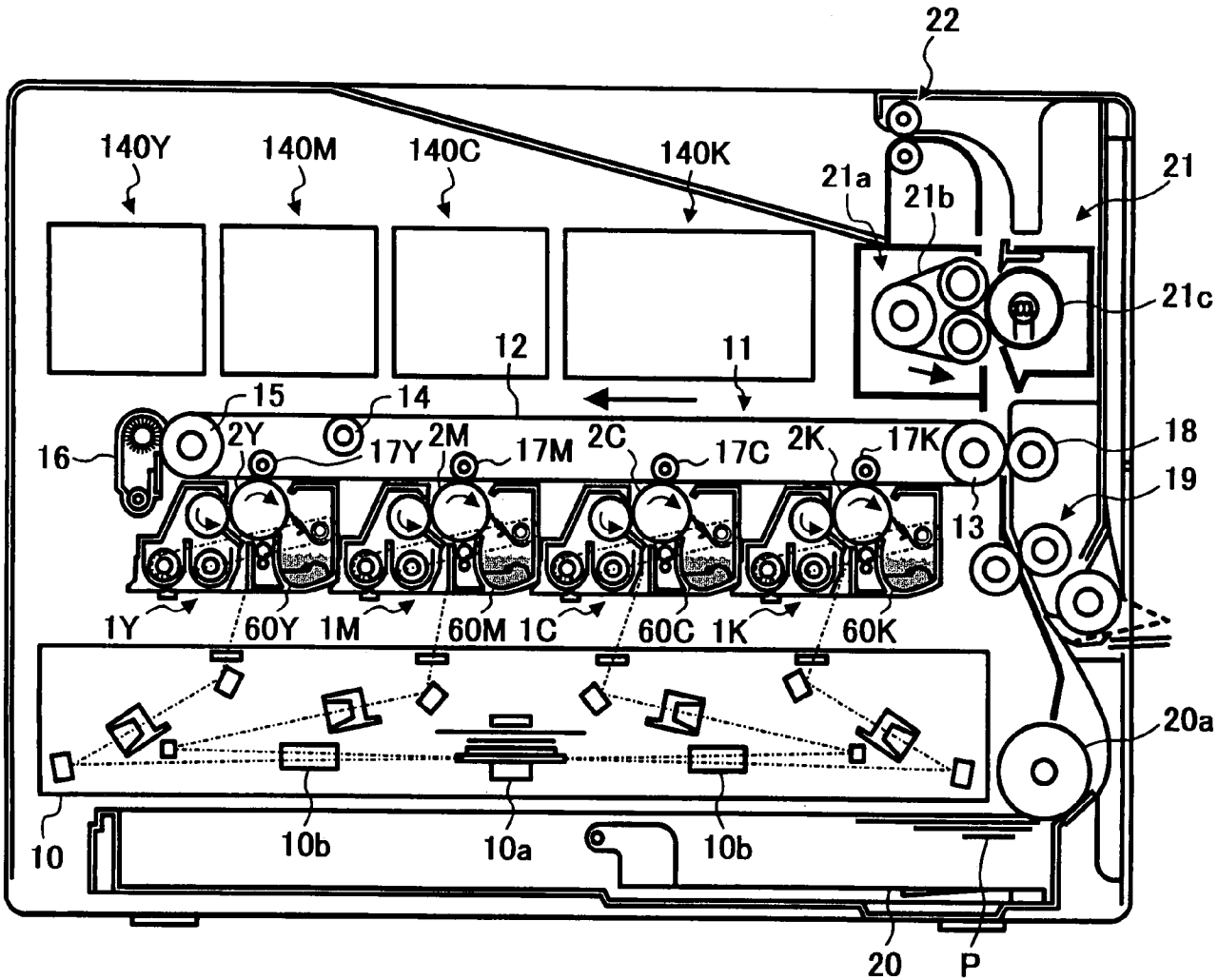
FIG. 1 is a schematic view of a color laser printer according to an embodiment of the present invention.

Preferred embodiments of the present invention are described in detail referring to the drawings, wherein like reference numerals designate identical or corresponding parts throughout the several views. The present invention is applied to a tandem-type color laser printer (hereafter referred to as a "printer") as a non-limiting example of an image forming apparatus, in which a plurality of image forming units (including photoconductive drums) are arranged along an intermediate transfer belt as an intermediate transfer element in the direction of movement of the intermediate transfer belt.

FIG. 1 is a schematic view of a color laser printer according to an embodiment of the present invention. The printer of FIG. 1 includes image forming units 1Y, 1M, 1C, and 1K that form yellow, magenta, cyan, and black toner images, respectively. The reference letters "Y", "M", "C", and "K" indicate members used for forming a yellow toner image, a magenta toner image, a cyan toner image, and a black toner image, respectively. The printer further includes a laser writing unit 10 functioning as a latent image forming device, an intermediate transfer unit 11, a secondary transfer bias roller 18, a pair of registration rollers 19, a sheet feeding cassette 20, and a belt-fixing type fixing unit 21. The laser writing unit 10 includes a laser light source (not shown), a polygon mirror 10*a*, f-theta lenses 10*b*, reflection mirrors, etc., and emits laser beams toward photoconductive drums (described below), respectively, in accordance with image information.

In the printer of FIG. 1, the image forming units 1Y, 1M, 1C, and 1K form yellow, magenta, cyan, and black toner images, respectively, and their configurations are substantially the same except for the color of their toner. For this reason, only the configuration of the image forming unit 1Y will be described hereinafter in detail.

Figure 2:
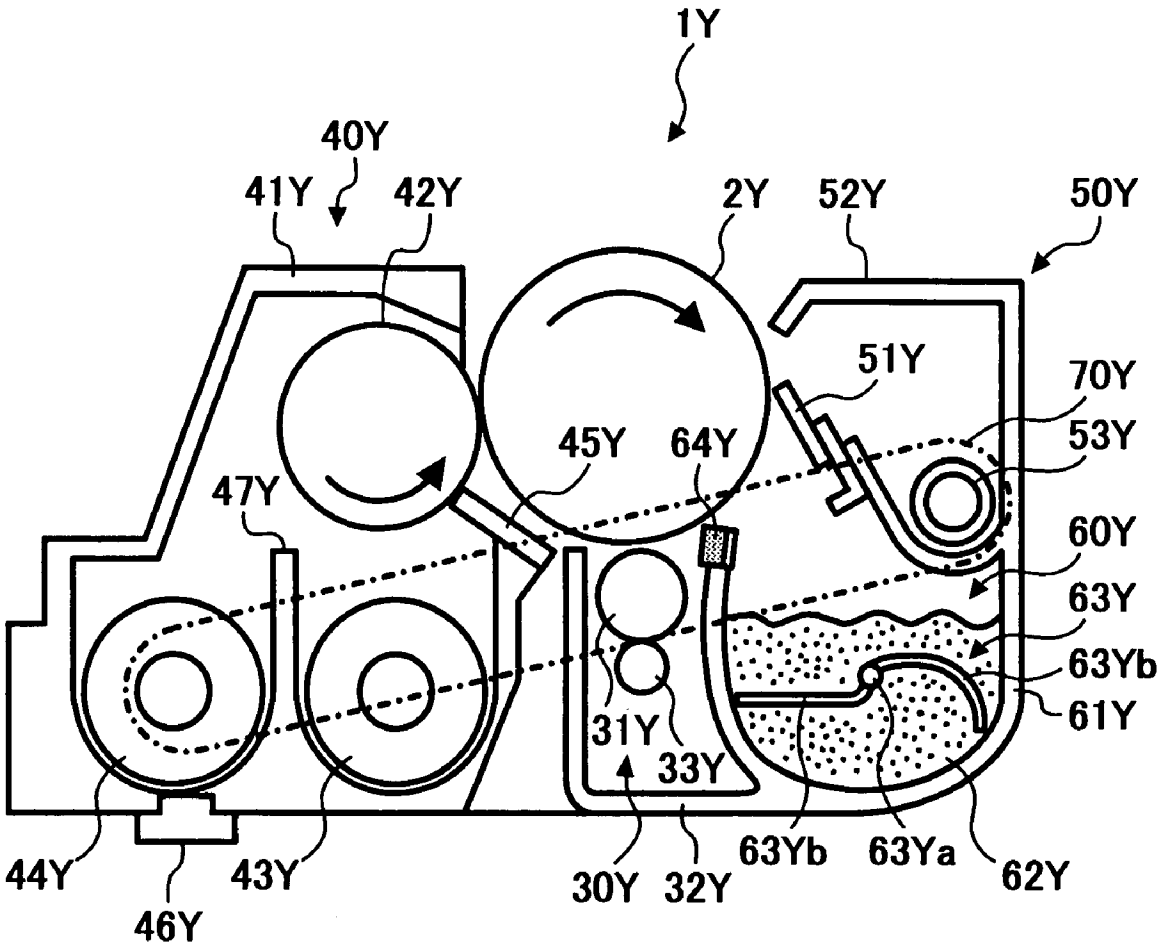
FIG. 2 is an enlarged view of an image forming unit that forms a yellow toner image.

FIG. 2 is an enlarged view of the image forming unit 1Y that forms a yellow toner image. The image forming unit 1Y includes a latent image carrier, such as a photoconductive drum 2Y functioning as one of moving members in the printer, a charging device 30Y, a developing device 40Y, a drum-cleaning device 50Y, a lubricant applying device 60Y, and a recycle toner conveying device 70Y.

The charging device 30Y includes a charging member, such as a charging roller 31Y provided in contact with the surface of the photoconductive drum 2Y. Alternatively, the charging roller 31Y may be provided adjacent to the surface of the photoconductive drum 2Y such that a small gap is formed between the surface of the photoconductive drum 2Y and a circumferential surface of the charging roller 31Y. The charging roller 31Y uniformly charges the surface of the photoconductive drum 2Y at a charging region.

In this embodiment, a direct current voltage is applied to the charging roller 31Y from a DC power supply (not shown). Alternatively, a voltage including an alternating current voltage superimposed on a direct current voltage may be applied to the charging roller 31Y. However, it is preferable that a direct current voltage is applied to the charging roller 31Y to reduce a stress on the photoconductive drum 2Y. In this case, a useful lifetime of the photoconductive drum 2Y can be extended. Further, the printer of FIG. 1 employs a so-called contact type charging method. Alternatively, the printer may employ a so-called non-contact type charging method using, for example, a corona charger. As compared to the non-contact type charging method, the contact type charging method may lessen charging unevenness and generation of ozone. The charging device 30Y further includes a brush roller 33Y configured to remove foreign substances from the surface of the charging roller 31Y. In place of the brush roller 33Y, another cleaning member may be provided.

After the surface of the photoconductive drum 2Y is uniformly charged by the charging device 30Y, the laser writing unit 10 irradiates the surface of the photoconductive drum 2Y with an optically modulated and deflected laser beam, thereby forming an electrostatic latent image on the surface of the photoconductive drum 2Y. Subsequently, the electrostatic latent image is developed with yellow toner into a yellow toner image by the developing device 40Y. The developing device 40Y includes a developing roller 42Y disposed such that a part of the circumferential surface of the developing roller 42Y is exposed to the outside through an opening of a developing case 41Y. The developing device 40Y further includes a first developer conveying screw 43Y, a second developer conveying screw 44Y, a doctor blade 45Y, and a toner density sensor 46Y.

The developing case 41Y accommodates a two-component developer (not shown) including magnetic carrier and negatively charged yellow toner. After the two-component developer is charged by friction while being agitated by the first and second developer conveying screws 43Y and 44Y, the two-component developer is conveyed by the first and second developer conveying screws 43Y and 44Y, and is then carried on the surface of the developing roller 42Y. At this time, the doctor blade 45Y regulates a height of the developer on the developing roller 42Y. Subsequently, when the regulated developer is carried to a developing region where the developing roller 42Y faces the photoconductive drum 2Y, the yellow toner in the developer is electrostatically attracted to an electrostatic latent image formed on the surface of the photoconductive drum 2Y. Thereby, the electrostatic latent image is developed as a yellow toner image. The two-component developer in which yellow toner is used for developing the electrostatic latent image on the photoconductive drum 2Y, is returned into the developing case 41Y by the rotation of the developing roller 42Y.

A partition wall 47Y is provided between the first and second developer conveying screws 43Y and 44Y to separate a developer storing space in the developing case 41Y into a first developer supplying section including the developing roller 42Y and the first developer conveying screw 43Y and into a second developer supplying section including the second developer conveying screw 44Y. The first developer conveying screw 43Y is rotated by a drive device (not shown) and supplies the two-component developer stored in the first developer supplying section to the developing roller 42Y while conveying the developer in the axial direction of first developing screw 43Y from a rear side to a front side of the image forming unit 1Y in FIG. 2.

The two-component developer conveyed by the first developer conveying screw 43Y to a position adjacent to an end portion of the first developer supplying section enters the second developer supplying section through a first opening (not shown) provided in the partition wall 47Y. In the second developer supplying section, the second developer conveying screw 44Y is rotated by a drive device (not shown) and conveys the two-component developer conveyed from the first developer supplying section in a direction opposite to a developer conveying direction of the first developer conveying screw 43Y. The two-component developer conveyed by the second developer conveying screw 44Y to a position adjacent to an end portion of the second developer supplying section returns to the first developer supplying section through a second opening (not shown) provided in the partition wall 47Y.

The yellow toner image formed on the photoconductive drum 2Y is primarily transferred onto an intermediate transfer element, such as an intermediate transfer belt 12 (described below). The toner, which has not been transferred onto the intermediate transfer belt 12 and is attached onto the surface of the photoconductive drum 2Y, is removed by the drum cleaning device 50Y. The drum cleaning device 50Y includes a cleaning blade 51Y. The cleaning blade 51Y is brought into contact with the surface of the photoconductive drum 2Y to scrape off the residual toner attached onto the surface of the photoconductive drum 2Y. As described above, the printer of the present embodiment employs a blade cleaning method in which residual toner remaining on the photoconductive drum 2Y is removed by the cleaning blade 51Y. In place of or together with the blade cleaning method, another cleaning method, such as a brush cleaning method using a fur brush as a cleaning member, may be employed. The inside of the drum cleaning device 50Y is a closed space formed inside an inner wall surface of a casing 52Y, the cleaning blade 51Y, and a partial surface of the photoconductive drum 2Y. With this configuration, the residual toner removed by the cleaning blade 51Y does not scatter from the drum cleaning device 50Y into the inside of the printer.

The drum cleaning device 50Y includes a toner conveying screw 53Y for conveying the residual toner removed by the cleaning blade 51Y in the axial direction of toner conveying screw 53Y from the rear side to the front side of the image forming unit 1Y in FIG. 2. The toner conveyed by the toner conveying screw 53Y is fed into the recycle toner conveying device 70Y. The recycle toner conveying device 70Y conveys the toner to the developing device 40Y. A toner discharging opening of the recycle toner conveying device 70Y is positioned at the front side of the second developer supplying section of the developing device 40Y in FIG. 2. Thus, the residual toner collected by the drum cleaning device 50Y is returned into the developing device 40Y by the recycle toner conveying device 70Y. Subsequently, the toner returned into the developing device 40Y is agitated and conveyed by the first and second developer conveying screws 43Y and 44Y, and is then reused for developing.

The lubricant applying device 60Y applies a lubricant onto the surface of the photoconductive drum 2Y where the drum cleaning device 50Y has removed residual toner. The configuration and operation of the lubricant applying device 60Y will be described below. The surface of the photoconductive drum 2Y onto which the lubricant is applied by the lubricant applying device 60Y is uniformly charged again by the charging device 30Y, and is prepared for a next image forming process.

Toner images of respective colors formed on the photoconductive drums 2Y, 2M, 2C, and 2K in the image forming units 1Y, 1M, 1C, and 1K, are sequentially and primarily transferred onto the intermediate transfer belt 12 of the intermediate transfer unit 11. As illustrated in FIG. 1, the intermediate transfer unit 11 includes a drive roller 13, tension rollers 14 and 15, a belt cleaning device 16, and primary transfer bias rollers 17Y, 17M, 17C, and 17K, in addition to the intermediate transfer belt 12. The intermediate transfer belt 12 is spanned around the drive roller 13 and the tension rollers 14 and 15, and is rotated in a counter-clockwise direction indicated by the arrow in FIG. 1 by the drive roller 13 driven by a drive system (not shown). Primary transfer biases are applied to the primary transfer bias rollers 17Y, 17M, 17C, and 17K from respective power supplies (not shown). Further, primary transfer nip parts are formed between the intermediate transfer belt 12 and the photoconductive drums 2Y, 2M, 2C, and 2K with the rear surface of the intermediate transfer belt 12 pressed by the primary transfer bias rollers 17Y, 17M, 17C, and 17K toward the photoconductive drums 2Y, 2M, 2C, and 2K, respectively. At each of the primary transfer nip parts, a primary transfer electric field is formed between the photoconductive drum and the primary transfer bias roller under the influence of the primary transfer bias.

A yellow toner image formed on the photoconductive drum 2Y is primarily transferred onto the intermediate transfer belt 12 under the influence of the primary transfer electric field and a nip pressure in a primary transfer region. Then, a magenta toner image formed on the photoconductive drum 2M, a cyan toner image formed on the photoconductive drum 2C, and a black toner image formed on the photoconductive drum 2K are sequentially transferred onto the intermediate transfer belt 12 and are each superimposed on the yellow toner image. As a result, a superimposed four-color toner image is formed on the intermediate transfer belt 12. The superimposed four-color toner image is secondarily transferred onto a recording material, such as a transfer sheet P, at a secondary transfer nip part (described below). The belt cleaning device 16 removes residual toner remaining on the surface of the intermediate transfer belt 12, which has passed through the secondary transfer nip part. The belt cleaning device 16 contacts the intermediate transfer belt 12 while being backed up by the tension roller 15.

The drive roller 13 of the intermediate transfer unit 11 contacts the secondary transfer bias roller 18 via the intermediate transfer belt 12, thereby forming the secondary transfer nip part. A secondary transfer bias is applied to the secondary transfer bias roller 18 from a power supply (not shown).

The sheet feeding cassette 20 is provided below the laser writing unit 10. The sheet feeding cassette 20 accommodates a stack of transfer sheets P. A sheet feeding roller 20*a* presses against the uppermost transfer sheet P. When the sheet feeding roller 20*a* is driven to rotate at a predetermined timing, the uppermost transfer sheet P is fed out from the sheet feeding cassette 20 toward a nip part between the registration rollers 19 through a sheet conveying path. On the other hand, the superimposed four-color toner image formed on the intermediate transfer belt 12 enters the secondary transfer nip part by the movement of the intermediate transfer belt 12. The registration rollers 19 feed out the transfer sheet P toward the secondary transfer nip part at a timing such that the transfer sheet P contacts the superimposed four-color toner image on the intermediate transfer belt 12 at the secondary transfer nip part. Subsequently, the superimposed four-color toner image is secondarily transferred onto the transfer sheet P under the influence of the secondary transfer bias and a nip pressure in a secondary transfer region. As a result, a full-color image is formed on the transfer sheet P. The transfer sheet P having the full-color image is conveyed to the fixing unit 21.

The fixing unit 21 includes a belt unit 21*a* in which a fixing belt 21*b* spanning three rollers rotates in the direction indicated by the arrow in FIG. 1, and a heating roller 21*c* including a heat source. The full-color image is fixed onto the surface of the transfer sheet P while the transfer sheet P passes through a nip part between the fixing belt 21*b* and the heating roller 21*c*. The transfer sheet P having passed through the fixing unit 21 is discharged from the printer by a pair of sheet discharging rollers 22. Reference characters 140Y, 140M, 140C, and 140K in FIG. 1 indicate toner supplying containers that supply toners of different colors to developing devices.

Next, a configuration and an operation of the lubricant applying device 60Y will be described. As illustrated in FIG. 1, the image forming units 1Y, 1M, 1C, and 1K include the lubricant applying devices 60Y, 60M, 60C, and 60K, respectively. Because their configurations and operations are substantially the same, only the configuration and operation of the lubricant applying device 60Y will be described as being representative.

As illustrated in FIG. 2, the lubricant applying device 60Y includes a casing 61Y that accommodates a fine-powder shaped lubricant 62Y in its inner space (i.e., closed space). The lubricant 62Y is used for decreasing the coefficient of friction between the surface of the photoconductive drum 2Y and the cleaning blade 51Y that contacts the surface of the photoconductive drum 2Y and the coefficient of friction between the surface of the photoconductive drum 2Y and a substance, such as yellow toner and magnetic carrier, which is carried on the surface of the photoconductive drum 2Y. The lubricant applying device 60Y further includes a lubricant applying member, such as an agitator 63Y, which applies the lubricant 62Y onto the surface of the photoconductive drum 2Y in the casing 61Y. The agitator 63Y includes a rotation shaft 63Y*a* that extends in parallel to a shaft of the photoconductive drum 2Y, and two rotary blades 63Y*b* that are provided onto the rotation shaft 63Y*a*. When rotating the agitator 63Y, the rotary blades 63Y*b* move the lubricant 62Y toward the surface of the photoconductive drum 2Y, and thereby the lubricant 62Y is attached onto the surface of the photoconductive drum 2Y.

The casing 61Y of the lubricant applying device 60Y is integrated with the casing 52Y of the drum cleaning device 50Y and a casing 32Y of the charging device 30Y. The lubricant applying device 60Y, the drum cleaning device 50Y, the charging device 30Y, and the photoconductive drum 2Y are integrally accommodated in a process cartridge. The process cartridge is configured to be detachably attached to the main body of the printer of FIG. 1. Respective inner spaces of the casings 32Y, 52Y, and 61Y are partitioned by a part of the casing and the cleaning blade 51Y. The lubricant applying device 60Y is provided at the outside of the drum cleaning device 50Y.

The casing 61Y of the lubricant applying device 60Y is constructed of the cleaning blade 51Y, a part integrated with the casing 32Y, and a part integrated with the casing 52Y. The casing 61Y includes an opening on the side facing the surface of the photoconductive drum 2Y. The cleaning blade 51Y, that acts as a first edge portion of two edge portions of the casing 61Y adjoining the opening, is located upstream of a second edge portion of the two edge portions of the casing 61Y in the moving direction of the surface of the photoconductive drum 2Y. The cleaning blade 51Y contacts the surface of the photoconductive drum 2Y over the entire range of the photoconductive drum 2Y in its axial direction. Further, a seal member 64Y is provided at the second edge portion of the casing 61Y which is located downstream of the first edge portion (i.e., the cleaning blade 51Y) of the casing 61Y in the moving direction of the surface of the photoconductive drum 2Y. The seal member 64Y contacts the surface of the photoconductive drum 2Y over the entire range of the photoconductive drum 2Y in its axial direction. Further, other seal members (not shown) are respectively provided at edge portions of the casing 61Y adjoining the opening located at both end portions of the photoconductive drum 2Y in its axial direction. Each of the other seal members contacts the surface of the photoconductive drum 2Y over the partial range of the photoconductive drum 2Y in the moving direction of the surface of the photoconductive drum 2Y. Thus, in the lubricant applying device 60Y of the present embodiment, all edge portions of the casing 61Y adjoining the opening contact the surface of the photoconductive drum 2Y over the entire range of the photoconductive drum 2Y in its axial direction and over the partial range of the photoconductive drum 2Y in the moving direction of the surface of the photoconductive drum 2Y. Therefore, an inner space of the casing 61Y which is surrounded by the inner wall surface of the casing 61Y and the partial surface of the photoconductive drum 2Y is a closed space shut off from outside. In this embodiment, as described above, the lubricant 62Y is applied and attached onto the surface of the photoconductive drum 2Y in the closed space by rotating the agitator 63Y. Subsequently, the lubricant 62Y attached onto the surface of the photoconductive drum 2Y passes through a contact part of the seal member 64Y and the surface of the photoconductive drum 2Y by the movement of the surface of the photoconductive drum 2Y.

Mechanical stress, which is applied to the photoconductive drum 2Y in the above-described image formation process, can be significantly decreased by attaching the lubricant 62Y onto the surface of the photoconductive drum 2Y. Specifically, the mechanical stress, such as the rub of the developer against the surface of the photoconductive drum 2Y in the developing region, and the scrape of the cleaning blade 51Y on the surface of the photoconductive drum 2Y, can be significantly reduced. As a result, a useful lifetime of the photoconductive drum 2Y can be increased. This advantage is especially effective in a process cartridge in which a photoconductive drum and other devices are integrally accommodated like the process cartridge of the present embodiment. Generally, a photoconductive drum has the shortest useful lifetime as compared to other devices accommodated in a process cartridge. An exchange frequency of a process cartridge depends on a useful lifetime of a photoconductive drum. Therefore, if a useful lifetime of a photoconductive drum is increased, an exchange frequency of a process cartridge is reduced. As a result, devices, which are accommodated in a process cartridge together with a photoconductive drum and are replaced with new ones before their useful lives end, can be effectively used. Further, user convenience can be enhanced by decreasing the replacement frequency. Moreover, as a result of decreasing a mechanical contact force between the surface of the photoconductive drum 2Y and toner by attaching the lubricant 62Y onto the surface of the photoconductive drum 2Y, transfer efficiency can be enhanced in a transfer region. As a result, advantages, such as enhancement of image quality, and decrease of residual toner remaining on the photoconductive drum 2Y, can be obtained.

In the present embodiment, the lubricant 62Y is applied onto the surface of the photoconductive drum 2Y in the above-described closed space. Therefore, a part of the lubricant 62Y to be applied onto the surface of the photoconductive drum 2Y does not scatter in the printer, and all the lubricant 62Y not applied onto the photoconductive drum 2Y stays in the closed space. Further, because the lubricant applying device 60Y is provided at the outside of the drum cleaning device 50Y, it does not happen such that a part of the lubricant 62Y to be applied onto the photoconductive drum 2Y is collected by the drum cleaning device 50Y without being applied onto the photoconductive drum 2Y. Moreover, in the present embodiment, the lubricant 62Y, which is moved toward the photoconductive drum 2Y by the agitator 63Y and is not applied onto the photoconductive drum 2Y, falls in the casing 61 and is moved again toward the photoconductive drum 2Y to be applied onto the photoconductive drum 2Y. With this configuration, all the lubricant 62Y accommodated in the casing 61 can be applied onto the photoconductive drum 2Y without wasting.

In the present embodiment, residual toner remaining on the photoconductive drum 2Y is collected by the drum cleaning device 50Y and is returned to the developing device 40Y by the recycle toner conveying device 70Y for reuse. In a background image forming apparatus in which residual toner remaining on a photoconductive drum is removed therefrom by a cleaning blade and a lubricant is applied onto a surface of the photoconductive drum by a brush roller in a drum cleaning device, a large amount of lubricants are mixed with the residual toner removed from the photoconductive drum by the cleaning blade.

Generally, it is known that a lubricant that mainly includes zinc stearate exerts a negative influence on a frictional charge of toner. Specifically, if a lubricant (zinc stearate) is mixed with negatively charged toner, a charge amount of the toner decreases (i.e., the charge of the toner shifts to a positive side). If a large amount of lubricants are mixed with toner, the charge amount of the toner gets short, thereby causing a stain of a background image. For these reasons, in the above-described background image forming apparatus, it may be difficult to reuse toner which is collected and mixed with lubricants in the drum cleaning device, and to control an occurrence of a stain of a background image at the same time.

On the other hand, in the printer of the present embodiment, because the lubricant applying device 60Y is provided at the outside of the drum cleaning device 50Y, the lubricant 62Y does not enter the drum cleaning device 50Y from the lubricant applying device 60Y. Further, in this embodiment, a lubricant applying position where the lubricant applying device 60Y applies the lubricant 62Y onto the surface of the photoconductive drum 2Y is located downstream of a cleaning position where the cleaning blade 51Y removes residual toner attached onto the surface of the photoconductive drum 2Y in the moving direction of the surface of the photoconductive drum 2Y. In this configuration, the lubricant 62Y attached onto the surface of the photoconductive drum 2Y reaches the cleaning position of the drum cleaning device 50Y through the charging region, the developing region, and the primary transfer region by the movement of the surface of the photoconductive drum 2Y. A part of the lubricant 62Y carried on the photoconductive drum 2Y is collected by the charging roller 31Y in the charging region. Further, a part of the lubricant 62Y carried on the photoconductive drum 2Y is collected into the developing device 40Y in the developing region. Subsequently, a part of the lubricant 62Y carried on the photoconductive drum 2Y is collected by the intermediate transfer belt 12 in the primary transfer region.

Thus, an amount of the lubricant 62Y applied onto the surface of the photoconductive drum 2Y by the lubricant applying device 60Y gradually decreases by the time the lubricant 62Y carried on the photoconductive drum 2Y reaches the cleaning position of the drum cleaning device 50Y. Therefore, as compared to the above-described background image forming apparatus, the amount of the lubricant 62Y mixed with the residual toner collected by the drum cleaning device 50Y is very small. In the printer of the present embodiment including a mechanism in which the lubricant 62Y, which may exert a negative influence on a frictional charge of toner, is applied onto the photoconductive drum 2Y, residual toner collected by the drum cleaning device 50Y can be reused without causing a stain of a background image.

Further, as described above, the lubricant applying position of the lubricant applying device 60Y is located downstream of the cleaning position of the drum cleaning device 50Y and upstream of the developing region where an electrostatic latent image formed on the photoconductive drum 2Y is developed with yellow toner, in the moving direction of the surface of the photoconductive drum 2Y. In this configuration, toner does not enter the lubricant applying device 60Y. If toner enters the lubricant applying device 60Y, the charge amount of toner decreases by being mixed with the lubricant 62Y as described above. If an image formation is performed in a condition that such toner having a low charge amount is attached onto the surface of the photoconductive drum 2Y together with the lubricant 62Y, a stain of a background image typically occurs. In the present embodiment, a stain of a background image is avoided because toner does not enter the lubricant applying device 60Y as described above.

The above-described positioning of the lubricant applying position of the lubricant applying device 60Y is effective, even if the lubricant applying device 60Y is not provided at the outside of the drum cleaning device 50Y and the inner space of the casing 61Y is not a closed space shut off from outside.

As described above, the seal member 64Y, which is provided at the second edge portion of the casing 61Y located downstream of the first edge portion (i.e., the cleaning blade 51Y) of the casing 61Y in the moving direction of the surface of the photoconductive drum 2Y, contacts the surface of the photoconductive drum 2Y over the entire range of the photoconductive drum 2Y in its axial direction. The seal member 64Y is formed from an elastic element made of urethane rubber. The contact pressure of the seal member 64Y against the photoconductive drum 2Y is substantially even in the direction orthogonal to the moving direction of the surface of the photoconductive drum 2Y. In this configuration, even though an amount of the lubricant 62Y applied by the agitator 63Y is uneven on the surface of the photoconductive drum 2Y, the lubricant 62Y attached onto the surface of the photoconductive drum 2Y is uniformly and thinly spread thereon when the lubricant 62Y passes through the contact part of the seal member 64Y and the surface of the photoconductive drum 2Y. By doing so, a uniform amount of the lubricant 62Y can be attached onto the surface of the photoconductive drum 2Y over the entire range thereof. Further, an excess amount of the lubricant 62Y can be prevented from being attached onto the surface of the photoconductive drum 2Y by adequately adjusting the contact pressure and the contact angle of the seal member 64Y relative to the surface of the photoconductive drum 2Y.

With such a seal member 64Y, the amount of the lubricant 62Y that enters the drum cleaning device 50Y can be controlled to be minimal. Therefore, a stain of a background image caused by the toner collected by the drum cleaning device 50Y for reuse is prevented. Further, because an amount of lubricant consumed per one time of image forming process can be controlled to be minimal, the amount of the lubricant prepared in the printer in advance can be decreased. This allows the printer to be downsized.

In the printer of the present embodiment, as illustrated in FIG. 2, a block-shaped seal member is used as the seal member 64Y. Alternatively, the seal member 64Y may be of another shape, such as a flat-plate shape.

In this embodiment, the toner used in the printer has a volume-based average particle diameter of 10 μm or less. In general, the smaller particle diameter a toner has, the better image qualities (e.g., high resolution) the toner has. When the toner has a volume-based average particle diameter of 10 μm or less, a high quality image that satisfies the user can be formed. However, the smaller particle diameter a toner has, the more the toner tends to pass through the contact part of the cleaning blade 51Y and the surface of the photoconductive drum 2Y. In this condition, the residual toner remaining on the surface of the photoconductive drum 2Y may not be removed therefrom by the cleaning blade 51Y.

In this embodiment, as the lubricant 62Y is attached onto the surface of the photoconductive drum 2Y, the coefficient of friction between the surface of the photoconductive drum 2Y and the toner decreases. Therefore, the residual toner blocked by the cleaning blade 51Y typically slips on the surface of the photoconductive drum 2Y, and does not easily pass through the contact part of the cleaning blade 51Y and the surface of the photoconductive drum 2Y. Thus, even though the printer of the present embodiment uses small particulate toner having a volume-based average particle diameter of 10 μm or less, the residual toner remaining on the surface of the photoconductive drum 2Y can be easily removed therefrom.

The above-described particle diameter of toner can be measured by, for example, a Coultar counter method using a measuring instrument for measuring particle diameter distribution of toner, such as Coultar counter II (manufactured by Coulter Electronics Limited). By using the above-described measuring instrument, the particle diameter and the volume of particles of sample toner are measured. The distribution of the volumes of toner particles is calculated from the particle diameter and the volume of particles of the sample toner measured. From the calculated distribution, the volume-based average particle diameter of toner particles are determined. As an electrolysis solution employed in the Coultar counter method, an aqueous solution of NaCl at about 1% can be employed, prepared by using a first grade NaCl.

The toner for use in the present embodiment is prepared by a polymerization method, and has a spherical form and an average circularity of 0.93 or greater. The toner prepared by a pulverization method has concave and convex portions at random on the surface thereof, so that the average circularity of the toner becomes low. If toner has concave and convex portions at random on the surface thereof, charging amounts of respective toner particles, which are charged by friction when toner particles are agitated and pass a doctor blade in a developing device, differ considerably between toner particles in a developer. As a result, a charging distribution of toner particles in a developer widens. In this condition, a transfer electric field is not uniformly exerted on the toner attached onto a photoconductive drum, and thereby image transfer efficiency decreases. On the other hand, the toner for use in the present embodiment prepared by a polymerization method has a substantially spherical form and has a smooth surface having little concave and convex portions. Thus, the difference of charging amounts of toner particles between toner particles in a developer is small, so that a charging distribution of toner in a developer narrows. In this condition, the behavior of toner subjected to an electrostatic force, such as a developing electric field and a transfer electric field, can be uniformalized, and image dot reproducibility can be enhanced. As compared to other toner preparation methods, the polymerization method has an advantage that an energy amount consumed when preparing toner lessens. This is superior in view of environmental benefits.

However, if the form of toner is substantially spherical, the toner tends to easily pass through the contact part of the cleaning blade 51Y and the surface of the photoconductive drum 2Y by the movement of the surface of the photoconductive drum 2Y. In this condition, the cleaning blade 51Y may not easily remove residual toner remaining on the surface of the photoconductive drum 2Y. The reasons for this are as follows.

Figure 3A:
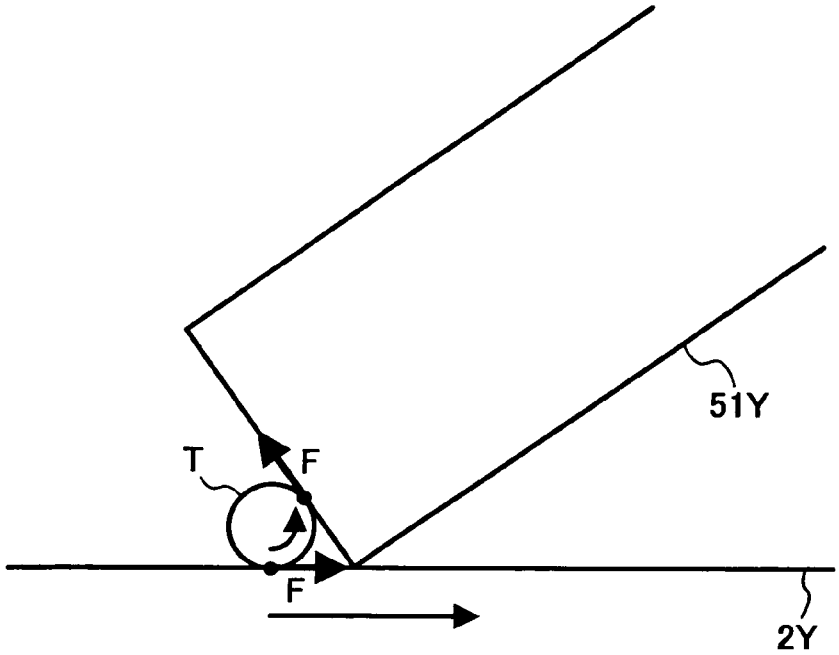
FIGS. 3A and 3B are schematic views for explaining behavior of residual toner on a surface of a photoconductive drum when the residual toner passes through a contact part of a cleaning blade and the surface of the photoconductive drum.
Figure 3B:
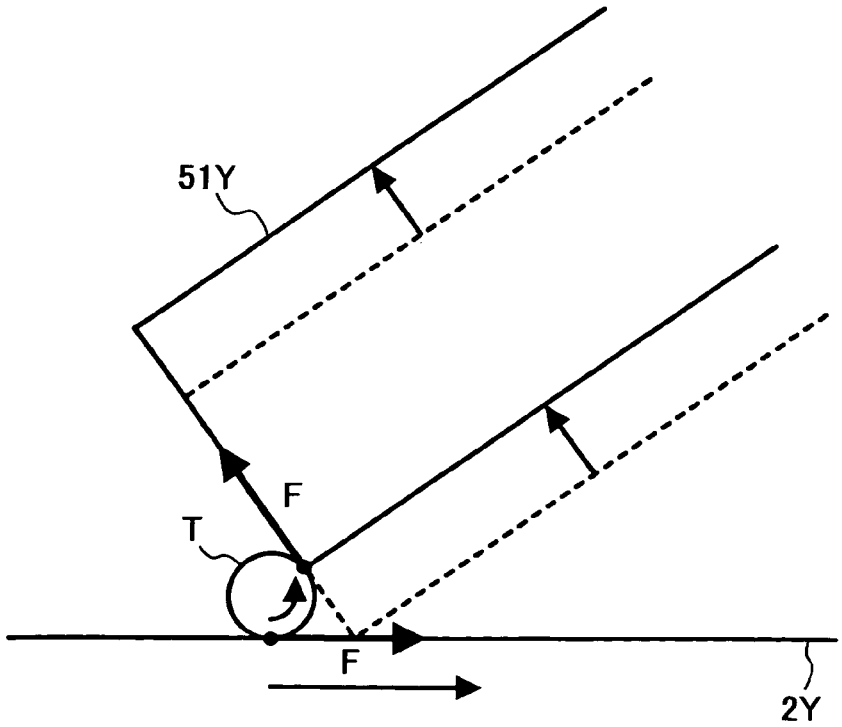

FIGS. 3A and 3B are schematic views for explaining behavior of residual toner (T) on the surface of the photoconductive drum 2Y when the residual toner (T) passes through the contact part of the cleaning blade 51Y and the surface of the photoconductive drum 2Y. As illustrated in FIG. 3A, the residual toner (T) is blocked by the cleaning blade 51Y when the residual toner (T) reaches the contact part of the cleaning blade 51Y and the surface of the photoconductive drum 2Y by the movement of the surface of the photoconductive drum 2Y. At this time, if the coefficient of static friction between the residual toner (T) and the surface of the photoconductive drum 2Y is high, the residual toner (T) rotates in the direction indicated by arrow in FIG. 3A by the movement of the surface of the photoconductive drum 2Y. Because a torque (F) produced at this time is transmitted to the cleaning blade 51Y in a direction of pressing up the cleaning blade 51Y, the residual toner (T) moves to get under the cleaning blade 51Y as illustrated in FIG. 3B. As the residual toner (T) gets under the cleaning blade 51Y, a restoring force of the cleaning blade 51Y transmitted to the residual toner (T) increases, so that normal component of reaction between the residual toner (T) and the surface of the photoconductive drum 2Y and normal component of reaction between the residual toner (T) and the cleaning blade 51Y increase. Thereby, the torque (F) of the residual toner (T) increases, and the increased torque (F) is transmitted to the cleaning blade 51Y. As a result, the residual toner (T) passes through the contact part of the cleaning blade 51Y and the surface of the photoconductive drum 2Y.

However, in the present embodiment, because the lubricant 62Y is applied onto the surface of the photoconductive drum 2Y, the coefficient of static friction between the residual toner (T) and the surface of the photoconductive drum 2Y may be lessened. In this condition, the residual toner (T) blocked by the cleaning blade 51Y slips on the surface of the photoconductive drum 2Y, so that a torque is not typically produced on the residual toner (T) and the residual toner (T) does not tend to pass through the contact part of the cleaning blade 51Y and the surface of the photoconductive drum 2Y. Thus, according to the present embodiment, even if toner which is prepared by a polymerization method and which has a high average circularity is used, the residual toner remaining on the surface of the photoconductive drum can be easily removed by the cleaning blade.

The average circularity of toner may be measured using a flow particle image analyzer FPIA-2100 manufactured by SYSMEX Co., Ltd. In the measurement, a 1% NaCl aqueous solution is prepared using first grade sodium chloride and passed through a 0.45 μm filter. 0.1 to 5 ml of a surfactant, preferably an alkylbenzene sulfonate, and 1 to 10 mg of sample, are then added to 50 to 100 ml of the filtrate as dispersant. The dispersion is performed for 1 minute in an ultrasonic dispersing machine, and measurement is performed on the dispersion wherein the particle concentration has been adjusted to 5,000 to 15,000 particles/μl. Pictures of the dispersion were taken with a CCD camera. From the two-dimensional pictures of particles, those having a circular equivalent diameter of 0.6 μm or more were selected for the calculation of average circularity, in view of the precision of the CCD pixels. Here, "circular equivalent diameter" means the diameter of a circle the area of which is the same as that of an observed particle. The average circularity is obtained by computing the circularity of each particle, summing the circularity of each particle, and dividing by the total number of particles. The circularity of each particle is computed by dividing the perimeter of a circle having an identical projected surface area to that of the particle image, by the perimeter of the particle image.

Next, another embodiment of the present invention applied to a tandem-type image forming apparatus, such as a color laser printer (hereafter referred to as a "printer"), will be described. The basic configuration of the printer of this embodiment is similar to that of the printer of FIG. 1. Therefore, the members of the printer of the present embodiment having substantially the same functions as those of the printer of FIG. 1 are indicated by the same reference characters.

Figure 4:
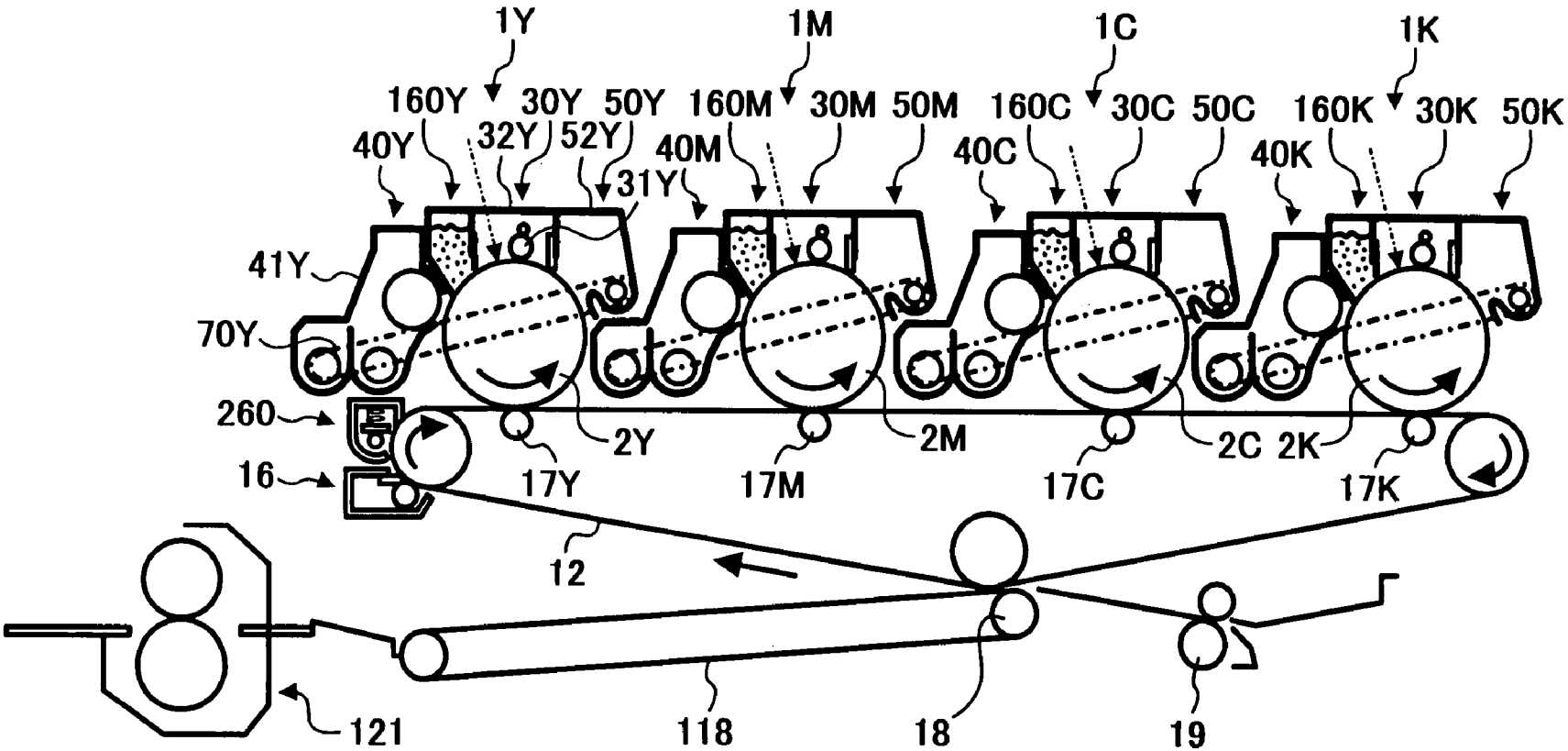
FIG. 4 is a schematic view of a main configuration of a color laser printer according to another embodiment of the present invention.

FIG. 4 is a schematic view of a main configuration of a printer according to the another embodiment of the present invention. The printer of the present embodiment is a tandem-type printer like the printer of FIG. 1. However, the image forming units 1Y, 1M, 1C, and 1K are disposed above the intermediate transfer belt 12 in the vertical direction. The printer of FIG. 4 further includes a recording material conveying member, such as a transfer sheet conveying belt 118, spanned around the secondary transfer bias roller 18 and a tension roller, and a fixing unit 121 employing a roller fixing method. The printer of FIG. 4 further includes lubricant applying devices 160Y, 160M, 160C, and 160K that apply lubricants onto the photoconductive drums 2Y, 2M, 2C, and 2K, respectively, and a lubricant applying device 260 that applies a lubricant onto the intermediate transfer belt 12.

Figure 5:
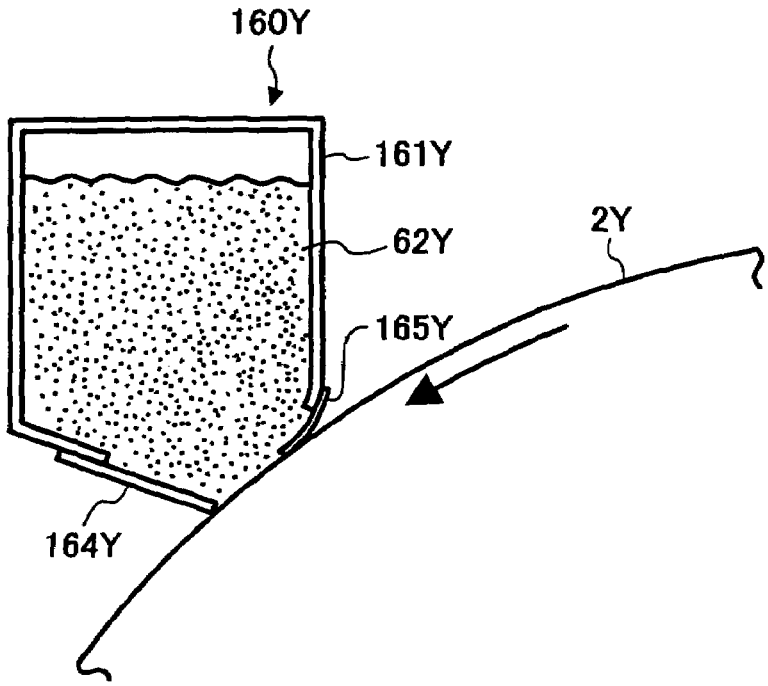
FIG. 5 is a schematic view of a lubricant applying device that applies a lubricant onto a photoconductive drum according to another embodiment of the present invention.

FIG. 5 is a schematic view of the lubricant applying device 160Y that applies a lubricant onto the photoconductive drum 2Y. Because configurations and operations of the lubricant applying devices 160Y, 160M, 160C, and 160K are substantially the same, only the configuration and operation of the lubricant applying device 160Y will be described as being representative. The lubricant applying device 160Y is disposed at an upper side relative to the surface of the photoconductive drum 2Y in the vertical direction. A casing 161Y of the lubricant applying device 160Y accommodates the fine-powder shaped lubricant 62Y in its inner space (i.e., closed space). As illustrated in FIG. 4, the casing 161Y of the lubricant applying device 160Y is integrated with the casing 32Y of the charging device 30Y, the casing 41Y of the developing device 40Y, and the casing 52Y of the drum cleaning device 50Y. The lubricant applying device 160Y, the charging device 30Y, the developing device 40Y, the drum cleaning device 50Y, and the photoconductive drum 2Y are integrally accommodated in a process cartridge. The process cartridge is configured to be detachably attached to the main body of the printer of FIG. 4. Respective inner spaces of the casings of the lubricant applying device 160Y, the charging device 30Y, the developing device 40Y, and the drum cleaning device 50Y are partitioned. The lubricant applying device 160Y is provided at the outside of the drum cleaning device 50Y. In this configuration, the lubricant 62Y does not enter the drum cleaning device 50Y from the lubricant applying device 160Y.

The casing 161Y of the lubricant applying device 160Y is constructed of a part integrated with the casing 32Y, a part integrated with the casing 41Y, a seal member 164Y (illustrated in FIG. 5), and a seal member 165Y (illustrated in FIG. 5). The casing 161Y includes an opening on the side facing the surface of the photoconductive drum 2Y. The seal member 165Y, that acts as a first edge portion of two edge portions of the casing 161Y adjoining the opening, is located upstream of the seal member 164Y, which constructs a second edge portion of the two edge portions of the casing 161Y, in the moving direction of the surface of the photoconductive drum 2Y. The seal members 164Y and 165Y contact the surface of the photoconductive drum 2Y over the entire range of the photoconductive drum 2Y in its axial direction.

Further, other seal members (not shown) are respectively provided at edge portions of the casing 161Y adjoining the opening located at both end portions of the photoconductive drum 2Y in its axial direction. Each of the other seal members contacts the surface of the photoconductive drum 2Y over the partial range of the photoconductive drum 2Y in the moving direction of the surface of the photoconductive drum 2Y. Thus, in the lubricant applying device 160Y of the present embodiment, all edge portions of the casing 161Y adjoining the opening contact the surface of the photoconductive drum 2Y over the entire range of the photoconductive drum 2Y in its axial direction and over the partial range of the photoconductive drum 2Y in the moving direction of the surface of the photoconductive drum 2Y. Therefore, an inner space of the casing 161Y which is surrounded by the inner wall surface of the casing 161Y, the seal members 164Y and 165Y, and the partial surface of the photoconductive drum 2Y is a closed space shut off from outside.

The seal member 164Y is formed from an elastic element made of urethane rubber. The contact pressure of the seal member 164Y against the photoconductive drum 2Y is substantially even in the direction orthogonal to the moving direction of the surface of the photoconductive drum 2Y. In this configuration, the lubricant 62Y attached onto the surface of the photoconductive drum 2Y is uniformly and thinly spread thereon when the lubricant 62Y passes through the contact part of the seal member 164Y and the surface of the photoconductive drum 2Y. By doing so, a uniform amount of the lubricant 62Y can be attached onto the surface of the photoconductive drum 2Y over the entire range thereof. Further, an excess amount of the lubricant 62Y can be prevented from being attached onto the surface of the photoconductive drum 2Y by adequately adjusting the contact pressure and the contact angle of the seal member 164Y relative to the surface of the photoconductive drum 2Y. Therefore, an amount of the lubricant prepared in the printer in advance can be decreased. This allows the printer to be downsized.

The lubricant applying device 160Y is configured such that the lubricant 62Y in its inner space moves toward the surface of the photoconductive drum 2Y by fluidity of the lubricant 62Y and gravity along the inner wall surface of the casing 161Y. Specifically, any part of the inner wall surface of the casing 161Y other than its top wall surface is configured to slant downward in the vertical direction toward the surface of the photoconductive drum 2Y.

Figure 6:
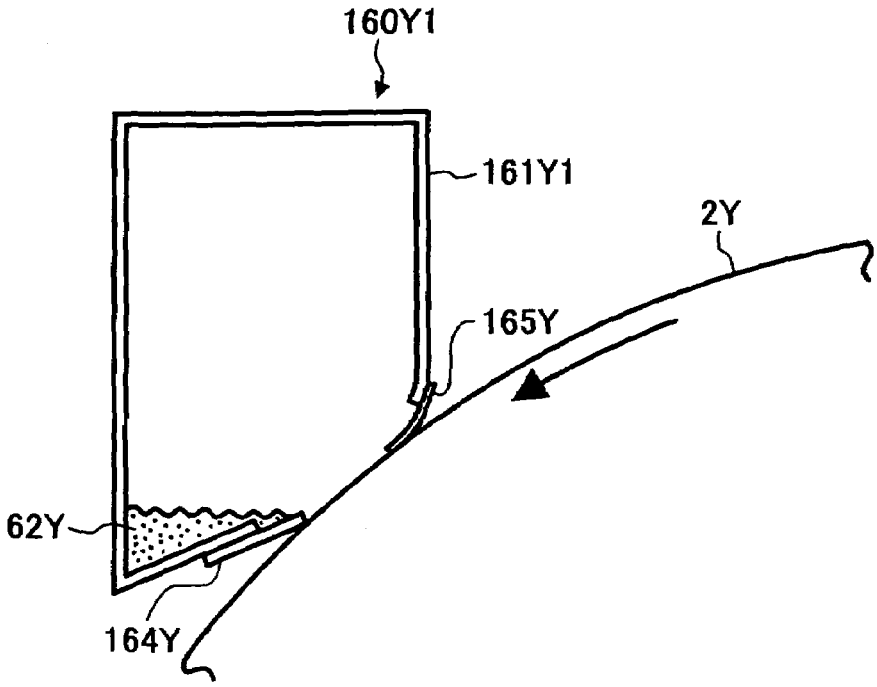
FIG. 6 is a schematic view of a lubricant applying device according to a comparative example.

FIG. 6 is a schematic view of a lubricant applying device 160Y1 according to a comparative example. As illustrated in FIG. 6, when an inner wall surface of a casing 161Y1 of the lubricant applying device 160Y1 includes a part that slants upward in the vertical direction toward the surface of the photoconductive drum 2Y, the lubricant 62Y stays at that part and cannot be applied onto the surface of the photoconductive drum 2Y properly. As compared to the lubricant applying device 160Y1, in the lubricant applying device 160Y of FIG. 5, all of the lubricant 62Y accommodated in the casing 161Y moves toward the surface of the photoconductive drum 2Y by gravity according to the consumption of the lubricant 62Y without staying in the inner space of the casing 161Y. Thus, the lubricant 62Y can be used up without staying in the casing 161Y and without wasting the lubricant 62Y.

The above-described configuration of the lubricant applying device 160Y, in which the lubricant 62Y in its inner space moves toward the surface of the photoconductive drum 2Y by gravity along the inner wall surface of the casing 161Y, is effective, even if the lubricant applying device 160Y is not provided at the outside of the drum cleaning device 50Y and the inner space of the casing 161Y is not a closed space shut off from outside.

Figure 7:
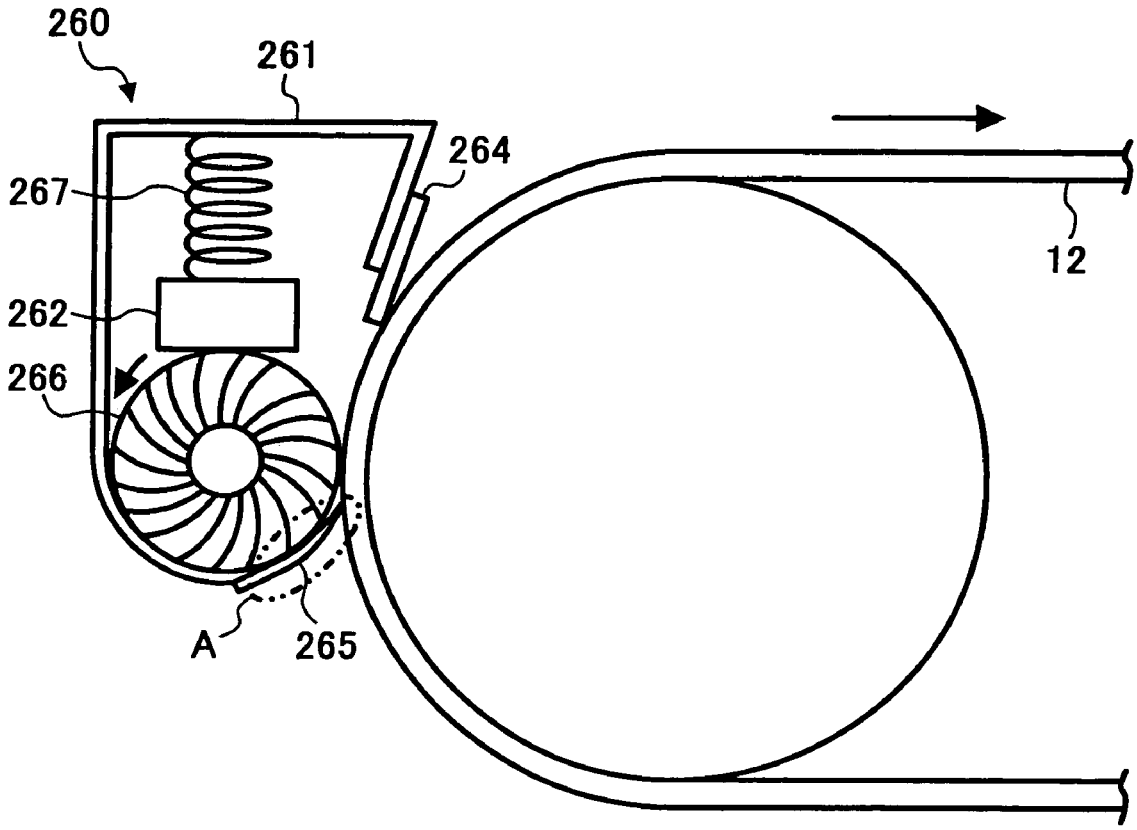
FIG. 7 is a schematic view of a lubricant applying device that applies a lubricant onto an intermediate transfer belt.

FIG. 7 is a schematic view of a lubricant applying device 260 that applies a lubricant onto the intermediate transfer belt 12. The lubricant applying device 260 is disposed in the substantially horizontal direction relative to the surface of a moving member, such as the intermediate transfer belt 12. The lubricant applying device 260 includes a solid lubricant 262 biased by a biasing member, such as a spring 267, and a brush-shaped rotary element, such as a brush roller 266, which rotates while rubbing against the solid lubricant 262 and the surface of the intermediate transfer belt 12 in an inner space (i.e., a closed space) of a casing 261. When the brush roller 266 is rotated, the solid lubricant 262 is scraped off by the brush roller 266, and is transformed into a powder lubricant. The powder lubricant attaches to the brush roller 266 and is then applied onto the surface of the intermediate transfer belt 12 by the brush roller 266.

The casing 261 of the lubricant applying device 260 includes a seal member 264 and a seal member 265. The casing 261 includes an opening on the side facing the surface of the intermediate transfer belt 12. The seal member 265, which constructs a first edge portion of two edge portions of the casing 261 adjoining the opening, is located upstream of the seal member 264, which constructs a second edge portion of the two edge portions of the casing 261, in the moving direction of the surface of the intermediate transfer belt 12. The seal members 264 and 265 contact the surface of the intermediate transfer belt 12 over the entire range of the intermediate transfer belt 12 in its widthwise direction.

The seal member 264 is formed from an elastic element made of urethane rubber. The contact pressure of the seal member 264 against the intermediate transfer belt 12 is substantially even in the direction orthogonal to the moving direction of the surface of the intermediate transfer belt 12. In this configuration, the lubricant 262 attached onto the surface of the intermediate transfer belt 12 is uniformly and thinly spread thereon when the lubricant 262 passes through the contact part of the seal member 264 and the surface of the intermediate transfer belt 12. By doing so, a uniform amount of the lubricant 262 can be attached onto the surface of the intermediate transfer belt 12 over the entire range thereof. Further, an excess amount of the lubricant 262 can be prevented from being attached onto the surface of the intermediate transfer belt 12 by adequately adjusting the contact pressure and the contact angle of the seal member 264 relative to the surface of the intermediate transfer belt 12. Therefore, an amount of the lubricant prepared in the printer in advance can be decreased. This allows the printer to be downsized.

Similarly as in the lubricant applying device 160Y, the lubricant applying device 260 is provided at the outside of the belt cleaning device 16 (illustrated in FIG. 4), and an inner space of the casing 261, which is surrounded by the inner wall surface of the casing 261, the seal members 264 and 265, and the partial surface of the intermediate transfer belt 12, is a closed space shut off from outside.

In the lubricant applying device 260, as illustrated in FIG. 7, the inner wall surface of the casing 261 includes a part (A) that slants upward in the vertical direction toward the surface of the intermediate transfer belt 12, which is different from the lubricant applying device 160Y of FIG. 5. In this configuration, the powder lubricant, which is scattered when the brush roller 266 scrapes off the solid lubricant 262 and when the brush roller 266 rubs against the surface of the intermediate transfer belt 12, may not move toward the surface of the intermediate transfer belt 12 by gravity and may stay around the part (A). If the brush roller 266 does not rub against a part of the scattered powder lubricant, the part of the scattered powder lubricant stays at the inner wall surface portion located at the lowest position of the casing 261 in the vertical direction. Because such a staying powder lubricant cannot be applied onto the surface of the intermediate transfer belt 12, the lubricant 262 in the casing 261 cannot be used up.

However, the lubricant applying device 260 of the present embodiment is configured such that the brush roller 266 rubs against the inner wall surface portion located at the lowest position of the casing 261 in the vertical direction where the scattered powder lubricant tends to stay. With this configuration, even if the powder lubricant stays at the inner wall surface portion, the brush roller 266 collects the staying powder lubricant and applies the powder lubricant onto the surface of the intermediate transfer belt 12. Thus, the lubricant 262 can be used up without staying in the casing 261.

The above-described configuration of the lubricant applying device 260, in which the brush roller 266 rubs against the inner wall surface portion of the casing 261 where the scattered powder lubricant tends to stay, is effective, even if the lubricant applying device 260 is not provided at the outside of the belt cleaning device 16 and the inner space of the casing 261 is not a closed space shut off from outside.

Further, the lubricant applying device 260 is configured to be detachably attached to the main body of the printer of FIG. 4, independently. In this configuration, the timing of the replacement of the lubricant applying device 260 may be set irrespective of the useful lifetime of other devices. Further, the lubricant applying device 260 may be designed with flexibility.

In a configuration such as in the lubricant applying device 160Y of FIG. 5 in which the lubricant 62Y accommodated in the casing 161Y moves toward the surface of the photoconductive drum 2Y by gravity along the inner wall surface of the casing 161Y, the above-described effects may be obtained by using a liquid lubricant as well as the fine-powder shaped lubricant. Further, similar effects may be obtained if the configuration such as in the lubricant applying device 160Y of FIG. 5 in which the lubricant 62Y accommodated in the casing 161Y moves toward the surface of the photoconductive drum 2Y by gravity along the inner wall surface of the casing 161Y, is applied to a configuration such as in the lubricant applying device 260 of FIG. 7 in which a powder lubricant obtained by scraping off the solid lubricant 262 by the brush roller 266 is applied onto the surface of the intermediate transfer belt 12 by the brush roller 266.

In the printer of FIG. 4, the lubricant applying position of the lubricant applying device 160Y is located downstream of the cleaning position of the drum cleaning device SOY and upstream of the developing region where an electrostatic latent image formed on the photoconductive drum 2Y is developed with yellow toner, in the moving direction of the surface of the photoconductive drum 2Y. Further, the lubricant applying position of the lubricant applying device 260 is located downstream of the cleaning position of the belt cleaning device 16 and upstream of the primary transfer region where toner images are attached onto the surface of the intermediate transfer belt 12. In this configuration, toner does not enter the lubricant applying devices 160Y and 260. Therefore, a stain of a background image caused by toner can be avoided.

Further, in the printer of FIG. 4, a lubricant applying position where the lubricant applying device 160Y applies the lubricant 62Y onto the surface of the photoconductive drum 2Y is located downstream of the charging position of the charging device 30Y where the charging roller 31Y is in contact with or adjacent to the surface of the photoconductive drum 2Y in the moving direction of the surface of the photoconductive drum 2Y. If an amount of the lubricant 62Y attached onto the charging roller 31Y increases, an amount of current flowing from the charging roller 31Y to the photoconductive drum 2Y decreases, and thereby charging failure may occur.

As described above, the lubricant applying device 160Y applies the lubricant 62Y onto the surface of the photoconductive drum 2Y on the downstream side of the charging position of the charging device 30Y in the moving direction of the surface of the photoconductive drum 2Y. In this configuration, the lubricant 62Y attached onto the surface of the photoconductive drum 2Y reaches the charging position of the charging device 30Y through the developing region, the primary transfer region, and the cleaning region by the movement of the surface of the photoconductive drum 2Y. A part of the lubricant 62Y carried on the photoconductive drum 2Y is collected into the developing device 40Y in the developing region. Further, a part of the lubricant 62Y carried on the photoconductive drum 2Y is collected by the intermediate transfer belt 12 in the primary transfer region. Subsequently, a part of the lubricant 62Y carried on the photoconductive drum 2Y is collected by the cleaning blade 51Y in the cleaning region.

As described above, an amount of the lubricant 62Y applied onto the surface of the photoconductive drum 2Y by the lubricant applying device 160Y gradually decreases by the time the lubricant 62Y carried on the photoconductive drum 2Y reaches the charging position of the charging device 30Y. Therefore, an amount of the lubricant 62Y attached onto the charging roller 31Y can be significantly reduced. As a result, an occurrence of charging failure can be controlled.

If a non-contact type charging method using a corona charger is employed, the above-described charging failure caused by lubricant does not occur. However, as described above, as compared to the non-contact type charging method, a contact type charging method may lessen charging unevenness and generation of ozone. When locating the lubricant applying position of the lubricant applying device 160Y downstream of the charging position of the charging device 30Y, the occurrence of charging failure can be controlled as described above. Further, the printer can employ the contact type charging method which is advantageous as compared to the non-contact type charging method.

The above-described positioning of the lubricant applying position of the lubricant applying device 160Y is effective, even if the lubricant applying device 160Y is not provided at the outside of the drum cleaning device 50Y and the inner space of the casing 161Y is not a closed space shut off from outside.

In the above-described embodiments, the lubricant applying device 60Y, the drum cleaning device 50Y, the charging device 30Y, and the photoconductive drum 2Y are integrally accommodated in a process cartridge. The process cartridge is configured to be detachably attached to the main body of the printer of FIG. 1. Further, the lubricant applying device 160Y, the charging device 30Y, the developing device 40Y, the drum cleaning device 50Y, and the photoconductive drum 2Y are integrally accommodated in a process cartridge. The process cartridge is configured to be detachably attached to the main body of the printer of FIG. 4.

Alternatively, each of the lubricant applying devices 60Y and 160Y may be configured to be detachably attached to the main body of the printer, independently. By doing so, timing for replacement of the lubricant applying devices 60Y and 160Y can be set irrespective of the useful lifetime of the photoconductive drum 2Y. Further, the lubricant applying devices 60Y and 160Y may be designed with flexibility. For example, each size of the lubricant applying devices 60Y and 160Y may be reduced while decreasing the amount of the lubricant 62Y for use therein. This allows the printer to be downsized. Alternatively, each size of the lubricant applying devices 60Y and 160Y may be increased while increasing the amount of the lubricant 62Y for use therein. This allows the lubricant applying devices 60Y and 160Y to be replaced less frequently.

As described above, in the lubricant applying devices 60Y, 160Y, and 260, all lubricants accommodated in their casings can be applied to the moving members, such as the photoconductive drum 2Y and the intermediate transfer belt 12 without wasting lubricant. Therefore, a greater amount of lubricant than necessary need not be prepared because the lubricant is not wasted. This allows the apparatus to be downsized.

Each of the printers of FIGS. 1 and 4 includes a toner recycle device, such as the recycle toner conveying device 70Y, that conveys residual toner collected by the drum cleaning device 50Y to the developing device 40Y for reuse in an image forming process. By using the toner recycle device, the amount of waste toner can be reduced, so that a system in view of environmental benefits can be provided. Further, the replacement of the waste toner collection bottle filled with waste toner can be decreased. As described above, in the printer of FIG. 1 in which the lubricant applying position of the lubricant applying device 60Y is located downstream of the cleaning position of the drum cleaning device 50Y in the moving direction of the surface of the photoconductive drum 2Y, the lubricant is prevented from being mixed with the residual toner collected by the drum cleaning device 50Y. Thus, even if a printer includes a mechanism that applies a lubricant, which may exert a negative influence on a frictional charge of toner, onto a photoconductive drum, the printer can use a toner recycle device that reuses residual toner collected by a drum cleaning device while controlling an occurrence of a stain of a background image.

Further, each of the printers of FIGS. 1 and 4 includes the process cartridge in which at least the photoconductive drum 2Y and the lubricant applying device 60Y or 160Y are integrally accommodated. The process cartridge is configured to be detachably attached to the main body of the printer. Such a process cartridge is provided in each of the image forming units 1Y, 1M, 1C, and 1K. With the process cartridge, at least the photoconductive drum and the lubricant applying device can be easily replaced with new ones when their useful lifetimes end, and the operability for the user can be enhanced.

In the above-described embodiments, because the lubricant is applied onto the surface of the photoconductive drum, the useful lifetime of the photoconductive drum can be extended. Thus, the frequency of the replacement of the process cartridge can be decreased, thereby enhancing the operability for the user. As described above, the printers of the present embodiments reuse the residual toner collected by the drum cleaning device in the developing device. In this configuration, the frequency of the replacement of a toner supplying container can be decreased. Therefore, in a process cartridge accommodating a toner supplying container in addition to a photoconductive drum and a lubricant applying device, the frequency of the replacement of the process cartridge can be also decreased.

Figure 8:
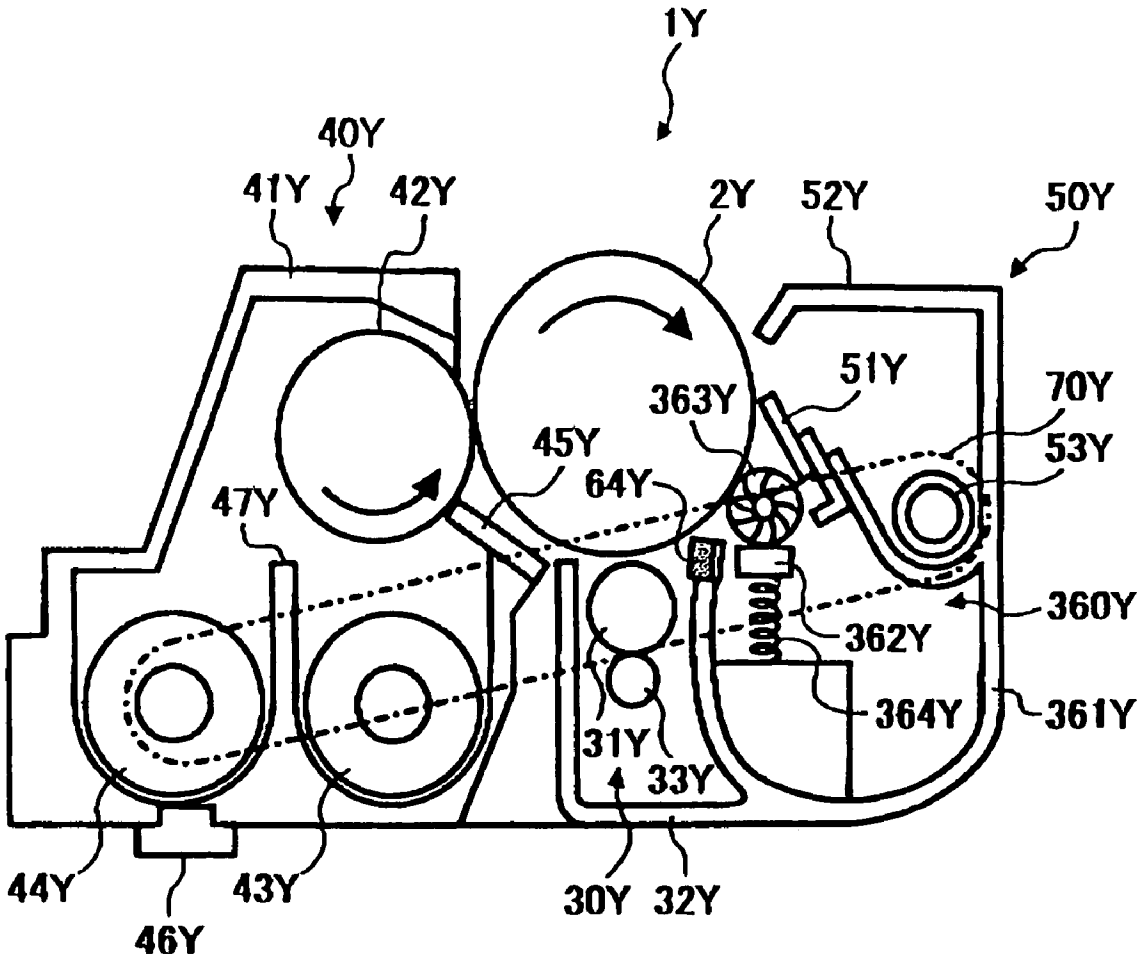
FIG. 8 is a schematic view of an image forming unit of the color laser printer of FIG. 1 according to an alternative embodiment of the present invention.

As described above, in the image forming unit 1Y of FIG. 2, the lubricant applying device 60Y applies the fine-powder shaped lubricant 62Y onto the surface of the photoconductive drum 2Y by use of the agitator 63Y. Alternatively, the lubricant applying device 60Y may use a solid lubricant and a brush roller to apply a lubricant onto the surface of the photoconductive drum 2Y. FIG. 8 is a schematic view of an image forming unit of the color laser printer of FIG. 1 according to an alternative embodiment of the present invention. As illustrated in FIG. 8, a lubricant applying device 360Y includes a solid lubricant 362Y biased by a biasing member, such as a spring 364Y, and a brush-shaped rotary element, such as a brush roller 363Y, which rotates while rubbing against the solid lubricant 362Y and the surface of the photoconductive drum 2Y in an inner space (i.e., a closed space) of a casing 361Y. When the brush roller 363Y is rotated, the solid lubricant 362Y is scraped off by the brush roller 363Y, and is transformed into a powder lubricant. The powder lubricant attaches to the brush roller 363Y and is then applied onto the surface of the photoconductive drum 2Y by the brush roller 363Y. The image forming unit 1Y of FIG. 8 exhibits similar effects to those in the image forming unit 1Y of FIG. 2.

The present invention has been described with respect to the exemplary embodiments illustrated in the figures. However, the present invention is not limited to these embodiments and may be practiced otherwise.

In the above-described embodiments of the present invention, the printers use a two-component developer including toner and magnetic carrier for development. However, even if the printers use one-component developer including toner, similar effects may be obtained.

The present invention has been described with respect to a printer as an example of an image forming apparatus. However, the present invention may be applied to other image forming apparatuses, such as a copying machine, a facsimile machine, a multi-functional image forming apparatus, etc.

Further, in place of the full-color printer, a mono-color printer may also be used.

Moreover, in place of a tandem-type image forming apparatus including a plurality of photoconductive drums, the present invention may be applied to an image forming apparatus including one photoconductive drum on which toner images of different colors are sequentially formed.

Each configuration of the lubricant applying devices 60Y, 160Y, 260, and 360Y may be used for any moving member other than the photoconductive drum 2Y and the intermediate transfer belt 12, such as the transfer sheet conveying belt 118.

Numerous additional modifications and variations of the present invention are possible in light of the above teachings. It is therefore understood that within the scope of the appended claims, the present invention may be practiced other than as specifically described herein.

What is claimed:

1. An image forming apparatus, comprising:

a moving member;

a cleaning device configured to remove toner attached onto a surface of the moving member; and a lubricant applying device provided outside of the cleaning device and configured to apply a lubricant onto the surface of the moving member, the lubricant applying device including a casing comprising:

an opening facing the surface of the moving member;

first and second edge portions adjoining the opening and contacting the surface of the moving member;

an inner wall surface;

a brush rotary element, wherein a closed space is formed by the inner wall surface of the casing and the surface of the moving member, and the lubricant applying device accommodates the lubricant in the closed space and applies the lubricant to the surface of the moving member in the closed space, and wherein the brush rotary element is configured to rub against the surface of the moving member and to rub against the inner wall surface.

2. The image forming apparatus according to claim 1, wherein the lubricant applying device is configured such that the lubricant accommodated in the closed space moves toward the surface of the moving member forming the closed space along the inner wall surface of the casing due to gravity and fluidity of the lubricant.

3. The image forming apparatus according to claim 1, wherein the lubricant applying device further includes a solid lubricant, wherein the brush rotary element is configured to rotate to scrape off the solid lubricant and the lubricant scraped off by the brush rotary element is transformed into a powder lubricant, and the lubricant applying device is configured to apply the powder lubricant onto the surface of the moving member, and wherein the lubricant applying device is configured such that the brush rotary element rubs against a portion of the inner wall surface of the casing where the powder lubricant tends to stay in the closed space.

4. The image forming apparatus according to claim 1, wherein the lubricant applying device is disposed such that a lubricant applying position where the lubricant applying device applies the lubricant onto the surface of the moving member is located downstream of a cleaning position where the cleaning device removes toner attached onto the surface of the moving member and is located upstream of a toner attaching position where toner is attached onto the surface of the moving member in a moving direction of the surface of the moving member.

5. An image forming apparatus, comprising:

a moving member;

a cleaning device configured to remove toner attached onto a surface of the moving member; and a lubricant applying device provided outside of the cleaning device and configured to apply a lubricant onto the surface of the moving member, the lubricant applying device including a casing comprising:

an opening facing the surface of the moving member;

first and second edge portions adjoining the opening and contacting the surface of the moving member; and an inner wall surface, wherein a closed space is formed by the inner wall surface of the casing and the surface of the moving member, and the lubricant applying device accommodates the lubricant in the closed space and applies the lubricant to the surface of the moving member in the closed space;

wherein the lubricant applying device further includes a rotary lubricant applying member in the closed space.

6. The image forming apparatus according to claim 5, wherein the closed space is located lower than the moving member in a direction of gravitational force.

7. The image forming apparatus according to claim 4, wherein the moving member includes a latent image carrier configured to carry a latent image on a surface of the latent image carrier;

wherein the cleaning device is configured to remove toner attached onto the surface of the latent image carrier;

wherein the image forming apparatus further comprises:

a charging device including a charging member configured to uniformly charge the surface of the latent image carrier, the charging member being one of in contact with or adjacent to the surface of the latent image carrier;

a latent image forming device configured to form a latent image on the surface of the latent image carrier that is uniformly charged by the charging member;

a developing device configured to develop the latent image carried on the surface of the latent image carrier with toner and form a toner image; and a transfer device configured to transfer the toner image formed by the developing device on the surface of the latent image carrier to a transfer element, wherein the lubricant applying device is disposed such that the lubricant applying position is located downstream of a charging position where the charging member charges the surface of the latent image carrier in the moving direction of the surface of the latent image carrier.

8. The image forming apparatus according to claim 1, wherein the first edge portion of the casing contacts the surface of the moving member on a downstream side of a lubricant applying position where the lubricant applying device applies the lubricant onto the surface of the moving member in a moving direction of the surface of the moving member, and the first edge portion is formed from an elastic element and is configured to contact the surface of the moving member with even pressure in a direction orthogonal to the moving direction of the surface of the moving member.

9. The image forming apparatus according to claim 1, wherein an average particle diameter of the toner is about 10 μm or less.

10. The image forming apparatus according to claim 1, wherein the toner is prepared by a polymerization method.

11. The image forming apparatus according to claim 1, further comprising a toner recycle device configured to convey the toner removed from the surface of the moving member by the cleaning device for reuse.

12. The image forming apparatus according to claim 1, wherein the lubricant applying device is configured to be detachably attached to a main body of an image forming apparatus, independently.

13. A process cartridge for use in a main body of an image forming apparatus, comprising:

a moving member;

a cleaning device configured to remove toner attached onto a surface of the moving member; and a lubricant applying device provided outside of the cleaning device and configured to apply a lubricant onto the surface of the moving member, the lubricant applying device including a casing including an opening facing the surface of the moving member and including an inner wall surface, wherein the moving member, the cleaning device, and the lubricant applying device are integrally accommodated in the process cartridge, and the process cartridge is detachably attached to the main body of the image forming apparatus, wherein a closed space is formed by the inner wall surface of the casing and the surface of the moving member, and the lubricant applying device accommodates the lubricant in the closed space and applies the lubricant to the surface of the moving member in the closed space, and wherein the lubricant applying device further includes a rotary lubricant applying member in the closed space.

14. The process cartridge according to claim 13, further comprising a charging device including a charging member configured to uniformly charge the surface of the moving member, the charging member being one of in contact with or adjacent to the surface of the moving member, wherein the lubricant applying device is disposed such that a lubricant applying position where the lubricant applying device applies the lubricant onto the surface of the moving member is located downstream of a charging position where the charging member charges the surface of the moving member in the moving direction of the surface of the moving member.

15. The process cartridge according to claim 13, wherein the closed space is located lower than the moving member in a direction of gravitational force.

16. The process cartridge according to claim 13, wherein the moving member includes a latent image carrier configured to carry a latent image on a surface of the latent image carrier.

17. An image forming apparatus, comprising:

a moving member;

means for removing toner attached onto a surface of the moving member; and means for applying a lubricant onto the surface of the moving member, the means for applying a lubricant provided outside of the means for removing and including:

means for accommodating the lubricant in a closed space; and means for scraping against a portion of an inner wall surface of the means for accommodating the lubricant.

18. The image forming apparatus according to claim 17, wherein the means for applying a lubricant includes:

means for moving the lubricant accommodated in the closed space toward the surface of the moving member forming the closed space along the inner wall surface of the means for accommodating the lubricant using gravity and fluidity of the lubricant.

19. The image forming apparatus according to claim 17, wherein the means for scraping is configured to scrape off a solid lubricant in the closed space and transforming the solid lubricant into a powder lubricant, and the means for applying a lubricant applies the powder lubricant onto the surface of the moving member, and wherein the means for scraping rubs against a portion of the inner wall surface of the means for accommodating the lubricant where the powder lubricant tends to stay in the closed space.

20. The image forming apparatus according to claim 17, wherein the means for applying a lubricant further includes means for agitating the lubricant in the closed space.

21. The image forming apparatus according to claim 19, wherein the moving member includes:

means for carrying a latent image on a surface thereof, wherein the means for removing toner includes:

means for removing toner attached onto the surface of the means for carrying a latent image, wherein the image forming apparatus further comprises, means for uniformly charging the surface of the means for carrying a latent image;

means for forming a latent image on the surface of the means for carrying a latent image that is uniformly charged by the means for uniformly charging;

means for developing the latent image carried on the surface of the means for carrying a latent image with toner and forming a toner image; and means for transferring the toner image formed by the means for developing on the surface of the means for carrying a latent image to a transfer element.

22. The image forming apparatus according to claim 21, further comprising means for conveying the toner removed from the surface of the moving member by the means for removing for reuse.

23. A process cartridge for use in a main body of an image forming apparatus, comprising:

a moving member;

means for removing toner attached onto a surface of the moving member; and means for applying a lubricant onto the surface of the moving member, the means for applying a lubricant provided outside of the means for removing and including:

means for accommodating the lubricant in a closed space, the means for accommodating the lubricant including an opening facing the surface of the moving member and an inner wall; and means for scraping against a portion of the inner wall surface of the means for accommodating the lubricant.

24. The process cartridge according to claim 23, further comprising:

means for uniformly charging the surface of the moving member.

25. The process cartridge according to claim 23, wherein the means for applying a lubricant further includes means for agitating the lubricant in the closed space.

26. The process cartridge according to claim 23, wherein the moving member includes, means for carrying a latent image on a surface thereof, wherein the means for removing toner includes:

means for removing toner attached onto the surface of the means for carrying a latent image, wherein the process cartridge further comprises, means for uniformly charging the surface of the means for carrying a latent image;

means for forming a latent image on the surface of the means for carrying a latent image that is uniformly charged by the means for uniformly charging;

means for developing the latent image carried on the surface of the means for carrying a latent image with toner and forming a toner image; and means for transferring the toner image formed by the means for developing on the surface of the means for carrying a latent image to a transfer element.

27. A method for forming an image that minimizes or avoids wasting lubricant in an image forming apparatus comprising:

removing residual toner attached onto a surface of a moving member;

applying lubricant, at a position outside of a cleaning device, onto the surface of the moving member;

accommodating the lubricant in a closed space formed by an inner wall surface of a casing and the surface of the moving member; and scraping off the lubricant from the inner wall in the closed space.

28. The method for forming an image that minimizes or avoids wasting lubricant in an image forming apparatus according to claim 27, further comprising:

applying lubricant to the moving member using gravity and fluidity of the lubricant.

29. The method for forming an image that minimizes or avoids wasting lubricant in an image forming apparatus according to claim 27, wherein the scraping off further comprises:

applying powder lubricant to the moving member by scraping a solid lubricant with a brush rotary element that rubs against the surface of the moving member and a portion of the inner wall surface of the casing where the powder lubricant tends to stay in the closed space.

30. The method for forming an image that minimizes or avoids wasting lubricant in an image forming apparatus according to claim 27, wherein the applying lubricant occurs downstream of a cleaning position where a moving member is cleansed of toner and upstream of a toner attaching position where toner is attached onto the surface of the moving member relative to a moving direction of the moving member.

31. The method for forming an image that minimizes or avoids wasting lubricant in an image forming apparatus according to claim 30, further comprising:

uniformly charging a surface of a latent image carrier;

forming a latent image on the surface of the latent image carrier;

developing the latent image carried on the surface of the latent image carrier into a toner image; and transferring the toner image onto a transfer element.

32. The method for forming an image that minimizes or avoids wasting lubricant in an image forming apparatus according to claim 27, further comprising:

recycling toner removed from the surface of the moving member for reuse.

33. The method for forming an image according to claim 27, further comprising:

transforming a solid lubricant into a powder lubricant.

34. An image forming apparatus, comprising:

a moving member;

a cleaning device configured to remove toner attached onto a surface of the moving member; and a lubricant applying device provided outside of the cleaning device and configured to apply a lubricant onto the surface of the moving member, the lubricant applying device including a casing comprising:

an opening facing the surface of the moving member;

first and second edge portions adjoining the opening and contacting the surface of the moving member; and an inner wall surface, wherein a closed space is formed by the inner wall surface of the casing and the surface of the moving member, and the lubricant applying device accommodates the lubricant in the closed space and applies the lubricant to the surface of the moving member in the closed space, and wherein the closed space is located lower than the moving member in a direction of gravitational force.

* * * * *